US007229387B2

(12) United States Patent
Wu et al.

(10) Patent No.: US 7,229,387 B2
(45) Date of Patent: Jun. 12, 2007

(54) APPARATUS FOR DIVERTING STATIC ELECTRICITY AWAY FROM A TREADMILL

(76) Inventors: Peter Wu, No. 1, Lane 233, Sec. 2, Charng Long Rd., Taiping (TW) 411; Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 105 days.

(21) Appl. No.: 10/813,399

(22) Filed: Mar. 31, 2004

(65) Prior Publication Data

US 2004/0198560 A1 Oct. 7, 2004

Related U.S. Application Data

(63) Continuation-in-part of application No. 10/107,715, filed on Mar. 28, 2002, now abandoned.

(51) Int. Cl.
*A63B 22/02* (2006.01)

(52) U.S. Cl. ..... 482/54; 119/700

(58) Field of Classification Search ..... 482/54, 482/51; 119/700

See application file for complete search history.

(56) References Cited

U.S. PATENT DOCUMENTS 4,227,487 A * 10/1980 Davis ..... 119/700
4,321,653 A * 3/1982 Takahashi ..... 361/219
4,760,456 A * 7/1988 Liang ..... 348/820
5,076,571 A * 12/1991 Croce et al. ..... 472/90
5,252,859 A * 10/1993 Tagney, Jr. ..... 290/1 R

* cited by examiner

*Primary Examiner*—(Jackie) Tan-Uyen Ho
*Assistant Examiner*—Tam Nguyen

(57) ABSTRACT

The invention relates to an apparatus for diverting static electricity away from a treadmill. The apparatus includes a diverting apparatus, consisting of a conducting piece, a conductive strip and a connection bolt. The diverting apparatus is mounted on the surface of the platform without influencing the smooth rotation of the continuous belt for carrying off the static electricity produced by friction within a walking area of the treadmill by providing a direct grounding path through the connection of the other end of the conductive strip to the ground.

3 Claims, 2 Drawing Sheets

APPARATUS FOR DIVERTING STATIC ELECTRICITY AWAY FROM A TREADMILL

The invention is a continuation-in-part of U.S. patent application Ser. No. 10/107,715 filed Mar. 28, 2002, now abandoned

BACKGROUND OF THE INVENTION

1. Fields of the Invention

The invention relates to an apparatus for diverting static electricity away from a treadmill, and more particularly, to an apparatus for diverting the electric charges stored on the treadmill to the ground so that the protection of operators and electronic components from injuries and damages is ensured.

2. Description of the Related Art

A treadmill 20, as shown in FIG. 2, includes a platform 27 and a base frame 22. A plurality of cushioning elements 271 are interposed between the platform 27 and the base frame 22 for cushioning impacts. A continuous belt 25 is mounted around the platform 27, the cushioning elements 271 and a front and rear roller 26. In this way, a basic in-place walking area is formed.

The continuous belt 25 can be guided by two rollers 26 for performing non-electric continuous cyclic motion by operators. Alternatively, a motor 28 can be employed to drive a transmission belt 29 to impart rotational motion to the two rollers 26. Therefore, the walking belt 25 can be moved around the platform 27 for an electric operation.

The treadmill 20 further includes a handrail 21 extending upwardly from the base frame 22. A control console 24 is installed on the handrail 21. During the operation of the electric mode, the control console 24 can give out a signal to activate or deactivate the motor 28. Even, it's possible to adjust the rotational speed of the continuous belt 25.

As well-known, molecule is the smallest physical unit of an element or compound, consisting of one or more like atoms in an element and two or more different atoms in a compound. Each atom consists of a nucleus containing combinations of neutrons and protons and one or more electrons bound to the nucleus by electrical attraction. In the ordinary state, the number of the protons with positive electric charge corresponds to the number of the electrons with negative electric charge. Thus, the atom is normally of no electric charge through the balance of the positive and negative electric charges. However, electrons bound to the nucleus can be taken away from the ordinary track by an external factor, like kinetic energy, potential energy, heat energy, chemical energy, etc. If the electric charge is not evenly distributed, the electric charge will accumulate and the static electricity is built up, especially on an insulating material.

When an operator stands on the continuous belt 25 for a jogging exercise or the continuous belt 25 circles around the front and rear roller 26, a stationary electric charge will be produced by friction. Due to the continuous action of contact and separation between the continuous belt 25 and the platform 27, the stationary electric charges are unceasingly built up on the surface of the platform 27. According to the law that like charges repel each other and unlike charges attract each other, the operator can't get an electric shock. In a serious case, it could cause an organic failure and endanger the life of the operator. In addition, the static electricity can be transmitted to mechanical or electrical components of the treadmill to increase their loading. Even, this could affect the functionality of the treadmill.

In order to eliminate the aforementioned drawbacks, a solution of TW 92207032 discloses a configuration with a conductive board fixed on a base frame of a treadmill. This conductive board is constantly pressed against the continuous belt so that the static electricity produced by friction during rotational motion can be removed by the conductive board to the base frame. However, this structure still has following drawbacks:

1. The installation of the conductive board against the continuous belt will cause the fact that the operator would worry about kicking this board and falling to the ground.
2. The friction increases due to the constant contact of the conductive board to the continuous belt. Therefore, the continuous belt is easily worn away and even broken off in a special case.

SUMMARY OF THE INVENTION

In light of the demerits of the prior art, the invention provides an apparatus for diverting static electricity away from a treadmill that aims to ameliorate at least some of the disadvantages of the prior art and to provide a useful alternative.

A primary objective of the invention is to provide an apparatus for diverting static electricity away from a treadmill to protect the operator from injuries and the mechanical and electronic components from damages.

Another objective of the invention is to provide an apparatus for diverting static electricity away from a treadmill that is easy to install and won't affect the performance of the exercise action.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
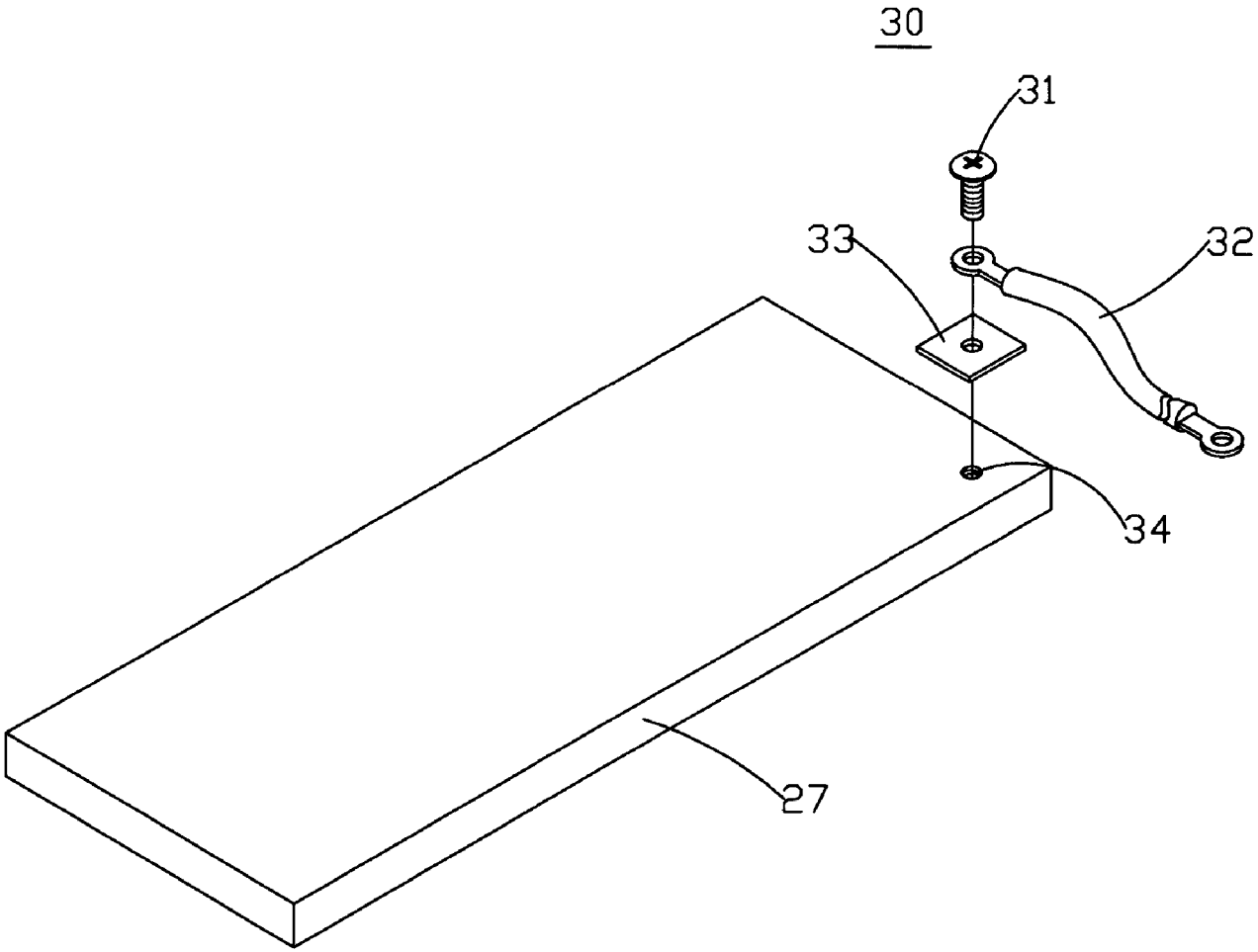
FIG. 1 is a perspective view of the invention installed to a platform of a conventional treadmill.

A platform 27 for a treadmill, as shown in FIG. 1, includes a threaded hole 34 at one of four corners thereof. A connection bolt 31 passes through one end of a conductive strip 32 and a conducting piece 33 and is screwed to the threaded hole 34. This builds up a complete diverting apparatus 30 of the invention.

As described above, the static electricity can be produced on the insulating material by friction. In fact, the action of friction is a process of contact and separation, causing the formation of unbalance of positive and negative electric charges. When the static electricity is stored to a certain extent, an electric discharge is created. Consequently, the static electricity stored on the platform 27 can be diverted away from the platform 27 of the treadmill by the conductive strip 32.

Figure 2:
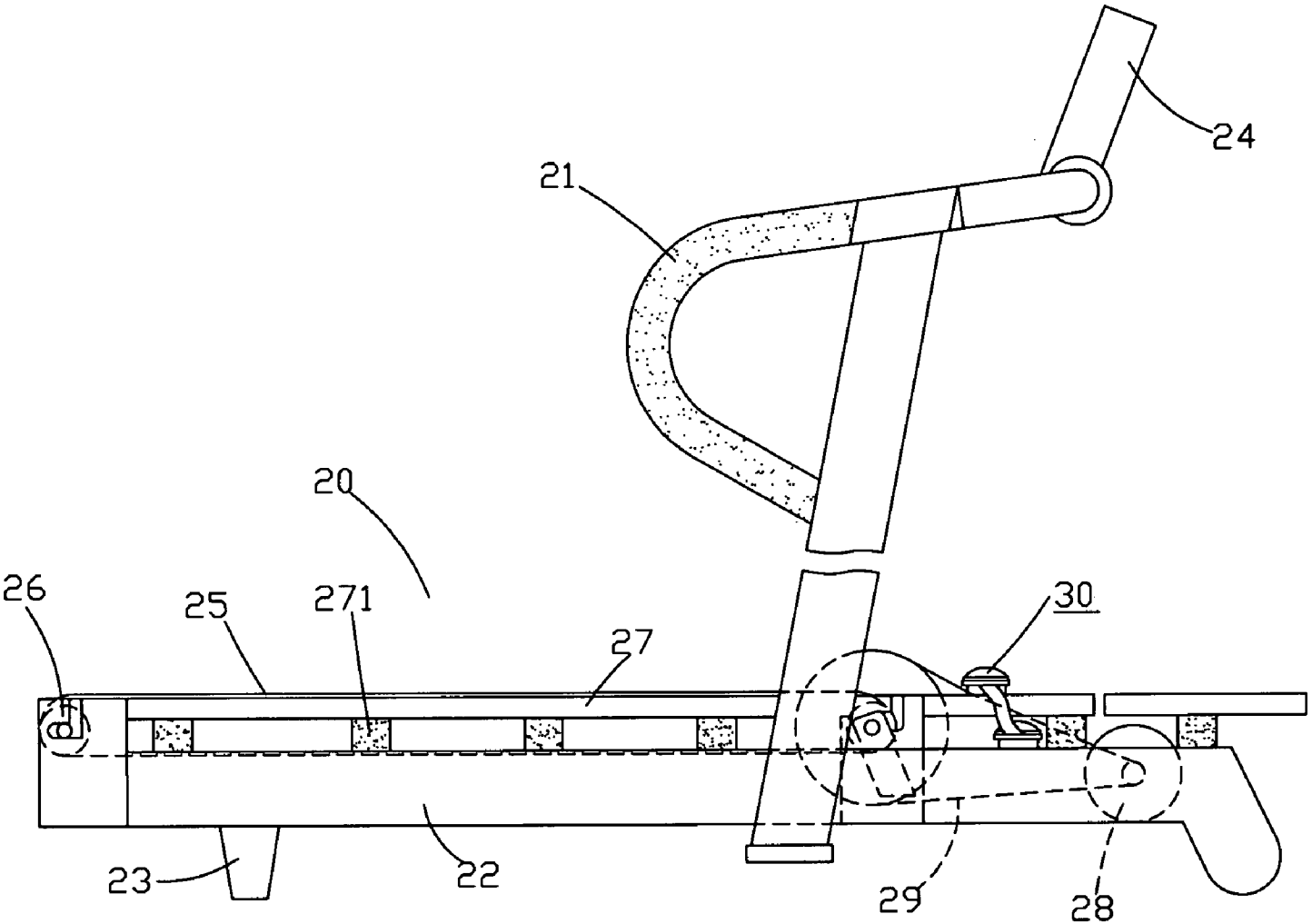
FIG. 2 is a side view of the invention installed to the conventional treadmill.

Referring to FIG. 2, the friction is formed most on the contact surface of the platform 27 with the continuous belt 25. Thus, most of static electricity is stored there. So, the diverting apparatus 30 of the invention can be mounted on the surface of the platform 27 without influencing the rotational motion of the continuous belt 25. Due to a ground piece 23 beneath the base frame 22, the static electricity stored on the platform 27 can be carried off by the conductive strip 32 to provide a direct path to the ground.

Moreover, the static electricity can be produced on the bottom surface of the platform 27. Therefore, the static electricity there can be diverted away from the platform 27 by another conductive piece and a nut (not shown).

Furthermore, the conducting piece 33 of the diverting apparatus 30 can be designed to have the same length as the length of the diagonal of the platform 27. Meanwhile, the conducting piece 33 is embedded or glued to the top and bottom surface of the platform 27. In this way, the effect in diverting static electricity away from a treadmill will be more significant.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A treadmill comprising:

a) a base frame;

b) a platform located above the base frame;

c) two rollers;

d) a continuous belt located around the platform and the two rollers;

e) a diverting apparatus having:

i) a conductive strip having a first end connected to the platform and a second end connected to a ground; and ii) a conducting piece located between the platform and the conductive strip, wherein the diverting apparatus diverting static electricity away from the platform of the treadmill; and (f) a connection bolt, the platform having a threaded hole, the connection bolt is inserted through a hole in the first end of the conductive strip and a hole in the conducting piece, and connected to the threaded hole of the platform.

2. The treadmill according to claim 1, further comprising a plurality of cushioning elements located between the platform and the base frame.

3. The treadmill according to claim 1, wherein the threaded hole is located on one of four corners of the platform.

* * * * *